US012733777B1

(12) United States Patent
Lin et al.

(10) Patent No.: US 12,733,777 B1
(45) Date of Patent: Sep. 15, 2026

(54) TOWEL HEATING BARREL

(71) Applicant: Guangzhou Hansong Tuojiang Technology Co., Ltd., Guangzhou (CN)

(72) Inventors: Zhenji Lin, Guangzhou (CN); Yueqing Li, Guangzhou (CN)

(73) Assignee: Guangzhou Hansong Tuojiang Technology Co., Ltd., Guangzhou (CN)

( * ) Notice: Subject to any disclaimer, the term of this patent is extended or adjusted under 35 U.S.C. 154(b) by 0 days.

(21) Appl. No.: 19/388,999

(22) Filed: Nov. 13, 2025

Related U.S. Application Data

(63) Continuation-in-part of application No. 30/007,614, filed on Jun. 10, 2025.

(30) Foreign Application Priority Data

Jun. 6, 2025 (CN) ..... 202530325603.8
Jun. 19, 2025 (CN) ..... 202521271936.8
Sep. 18, 2025 (CN) ..... 202522017377.4

(51) Int. Cl.
*A47K 10/06* (2006.01)

(52) U.S. Cl.
CPC ..... *A47K 10/06* (2013.01)

(58) Field of Classification Search
CPC ..... A47K 10/06
USPC ..... 34/619, 622; 248/127, 144, 145, 150, 248/149, 157, 165, 166, 439
See application file for complete search history.

(56) References Cited

U.S. PATENT DOCUMENTS 1,278,385 A * 9/1918 Rickard ..... A47J 43/22 248/101
3,577,650 A * 5/1971 Brahm ..... D06F 58/14 219/400
5,528,840 A * 6/1996 Pajak ..... A47L 23/20 34/235
2004/0007649 A1* 1/2004 Vettraino ..... F16M 13/00 248/127
2008/0289210 A1* 11/2008 Mangano ..... D06F 58/14 34/239
2012/0060388 A1* 3/2012 Rocheleau ..... F26B 13/101 34/659

FOREIGN PATENT DOCUMENTS

CN 117704508 * 3/2024 ..... F24F 13/12

* cited by examiner

*Primary Examiner* — John P McCormack

(57) ABSTRACT

A towel heating barrel includes a frame body, a base, an enclosing member, and a support member. The frame body defines an opening. The enclosing member is flexible and arranged between the frame body and the base. The enclosing member, the frame body, and the base cooperatively define a placement chamber. The opening is communicated with the placement chamber. The support member is movably arranged between the frame body and the base. The support member is configured to enable the frame body and the base to move close to or away from each other and enable the enclosing member to be folded or unfolded.

19 Claims, 18 Drawing Sheets

TOWEL HEATING BARREL

CROSS REFERENCE TO RELATED APPLICATIONS

This application is a continuation-in-part of the U.S. patent application Ser. No. 30/007,614, filed on Jun. 10, 2025, and claims priority to the Chinese patent application No. 202521271936.8, filed on Jun. 19, 2025, the Chinese patent application No. 202522017377.4, filed on Sep. 18, 2025, the Chinese patent application No. 202530325603.8, filed on Jun. 6, 2025, the disclosure of which are incorporated by reference herein in its entirety.

FIELD OF THE DISCLOSURE

The present disclosure relates to the field of household products, and in particular, to a towel heating barrel.

BACKGROUND

Towel heating barrels are primarily used for placing towels and heating towels. The towel heating barrel can quickly heat towels to a suitable temperature, allowing people to experience a more comfortable towel temperature when using towels after bathing or washing their faces. Currently, a barrel body of a towel heating barrel is generally of a fixed structure, which occupies a large space, cannot be deformed, and is inconvenient for carrying and storage.

SUMMARY

The following presents a simplified summary of the disclosure in order to provide a basic understanding of some aspects of the disclosure. This summary is not an extensive overview of the disclosure. It is not intended to identify critical elements or to delineate the scope of the disclosure. Its sole purpose is to present some concepts of the disclosure in a simplified form as a prelude to the more detailed description that is presented elsewhere.

In some embodiments, a towel heating barrel is provided. The towel heating barrel includes a frame body, a base, an enclosing member, and a support member. The frame body defines an opening. The enclosing member is flexible and arranged between the frame body and the base. The enclosing member, the frame body, and the base cooperatively define a placement chamber. The opening is communicated with the placement chamber. The support member is movably arranged between the frame body and the base. The support member is configured to enable the frame body and the base to move close to or away from each other and enable the enclosing member to be folded or unfolded.

BRIEF DESCRIPTION OF THE DRAWINGS

Illustrative embodiments of the present disclosure are described in detail below with reference to the attached drawing figures.

NUMERAL REFERENCE IN THE DRAWINGS

100—barrel body; 200—cover; 101—air chamber; 102—placement chamber; 1011—first chamber; 1012—second chamber; 1013—third chamber; 1014—bottom wall; 1015—first inner wall; 1016—second inner wall;

1—frame body; 11—opening; 12—mounting hole;

2—base; 21—limiting block; 211—groove; 22—communication port; 231—recess; 232—recess wall;

3—enclosing member;

4—support member; 41—support frame; 411—first end; 412—second end; 413—U-shaped portion; 4131—side rod; 4132—bottom rod; 414—first connecting portion; 415—second connecting portion;

5—hanging rod;

6—air outlet plate; 61—first corrugated portion; 62—second corrugated portion; 63—connecting plate; 600—ventilation hole; 601—concave portion; 602—convex portion;

7—air outlet mechanism; 71—housing; 72—blower; 73—air guide member; 74—heating element; 75—control panel; 710—working chamber; 711—air outlet; 712—air inlet; 713—upper shell; 714—lower shell; 715—partition plate; 731—air guide portion;

8—fragrance box; 81—box body; 82—slide rail; 821—guide rail; 822—arc portion;

9—handle;

G—air blowing direction of the air outlet mechanism; X—first direction; Y—second direction.

DETAILED DESCRIPTION

The following describes some non-limiting exemplary embodiments of the disclosure with reference to the accompanying drawings. The described embodiments are merely a part rather than all of the embodiments of the disclosure. All other embodiments obtained by a person of ordinary skill in the art based on the embodiments of the disclosure shall fall within the scope of the disclosure.

Unless otherwise defined, all technical and scientific terms used herein have the same meaning as commonly understood by those skilled in the art to which the present disclosure belongs. The terms used in the description of the present disclosure herein are intended for describing particular embodiments only and are not intended to limit the present disclosure. In the description, claims, and the above drawings of the present disclosure, the terms "including" and "having", as well as their variants, are intended to convey a non-exclusive inclusion. The terms "first", "second", etc., as used herein, are intended to distinguish between different objects, rather than to describe a particular order.

Reference to "embodiments" herein implies that a particular feature, structure, or characteristic described in conjunction with an embodiment may be included in at least one embodiment of the present disclosure. The appearance of the phrase at various places in the specification does not necessarily refer to the same embodiment, nor is it a separate or an alternative embodiment that is mutually exclusive of other embodiments. One skilled in the art would explicitly and implicitly understand that the embodiments described herein can be combined with other embodiments.

Figure 6:
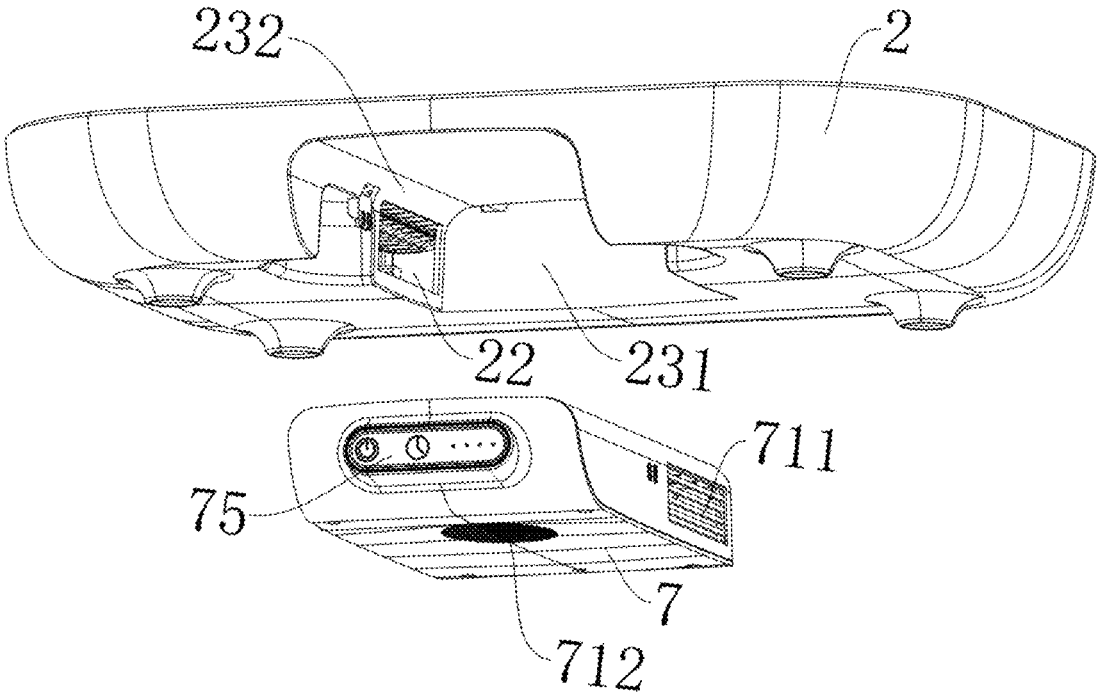
FIG. 6 is an exploded view of a base and an air outlet mechanism according to an embodiment of the present disclosure.

To solve the above technical problems, referring to FIGS. 1-5, an embodiment of the present disclosure provides a towel heating barrel. The towel heating barrel may include a barrel body 100 and an air outlet mechanism 7 arranged in the barrel body 100. The barrel body 100 may include a frame body 1, a base 2, an enclosing member 3 which is flexible, and a support member 4. The frame body 1 and the base 2 may be arranged spaced apart from each other in an up-down positional relationship. In some practical examples, both the frame body 1 and the base 2 may be rigid. The enclosing member 3 may be arranged between the frame body 1 and the base 2. The enclosing member 3, the frame body 1, and the base 2 cooperatively define a placement chamber 102. The enclosing member 3 may be made of flexible fabric, leather, or other materials, allowing a certain degree of deformation. The frame body 1 may be a rectangular frame. An inner side of the frame body 1 may define an opening 11, and the opening 11 may be communicated with the placement chamber 102. A user can place items such as towels and underwear that need heating in the placement chamber 102 through the opening 11. Referring to FIG. 6, the air outlet mechanism 7 may blow hot air into the placement chamber 102 to dry the towels, underwear, and other items in the placement chamber 102.

The support member 4 may be movably arranged between the frame body 1 and the base 2, enabling the frame body 1 and the base 2 to move towards each other or away from each other. That is, when the support member 4 supports the frame body 1 and the base 2, the frame body 1 and the base 2 may move away from each other, and the enclosing member 3 may unfold accordingly until a barrel shape is formed. When the support member 4 is disconnected from one of the frame body 1 and the base 2, the frame body 1 and the base 2 may move close to each other, and the enclosing member 3 may fold accordingly, facilitating the user carrying and storage.

Figure 3:
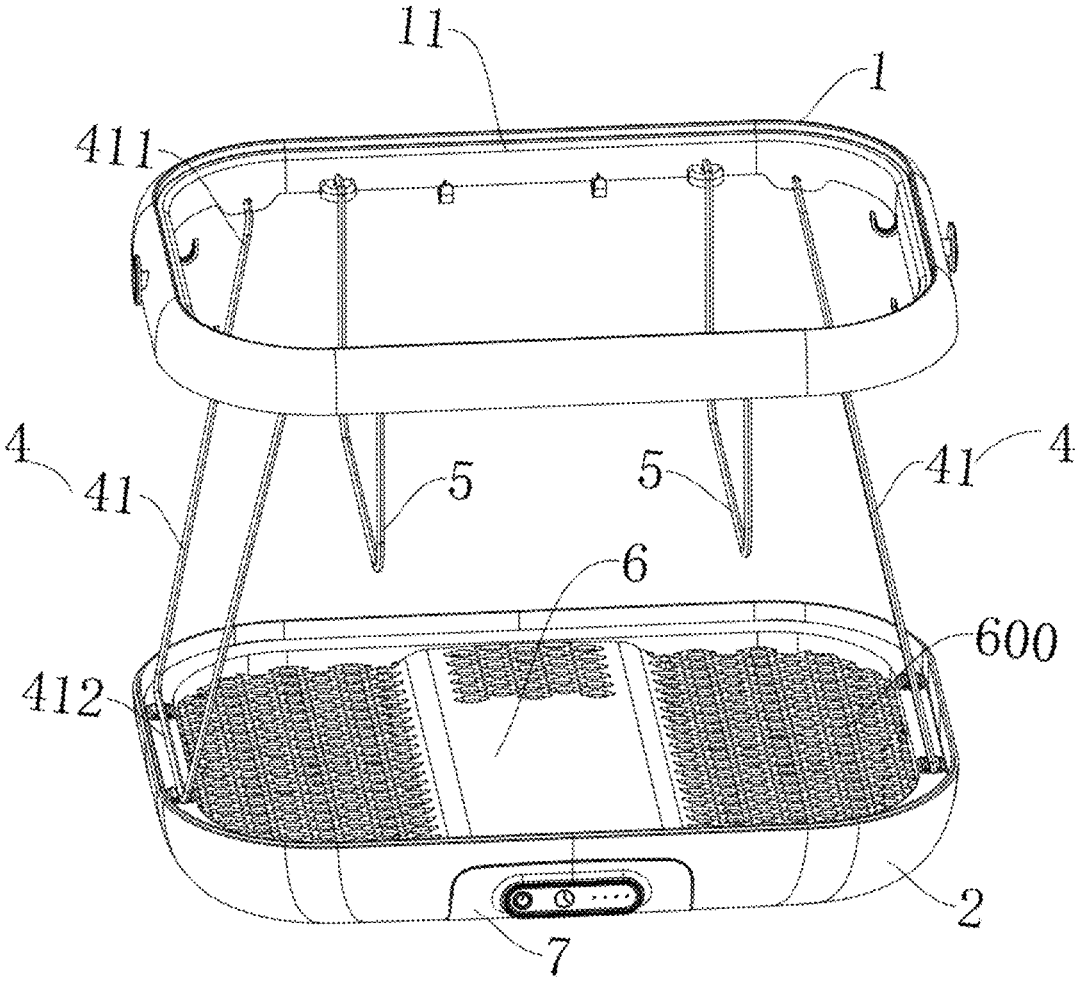
FIG. 3 is a partial structural view of the towel heating barrel according to an embodiment of the present disclosure.

In one embodiment, referring to FIG. 3, the support member 4 may include at least one support frame 41. The support frame 41 may include a first end 411 and a second end 412. The first end 411 may be rotatably arranged on one of the frame body 1 and the base 2, and the second end 412 may be detachably arranged on the other of the frame body 1 and the base 2. When the towel heating barrel needs to be folded for storage, the second end 412 of the support frame 41 may be detached from the frame body 1 or the base 2, and the first end 411 of the support frame 41 may be rotated until the support frame 41 is parallel or substantially parallel to the frame body 1 and the base 2, allowing the frame body 1 and the base 2 to move close to each other in a vertical direction. When unfolding, the second end 412 of the support frame 41 may be rotated in an opposite direction, and the first end 411 of the support frame 41 may be reassembled to the frame body 1 or the base 2. The number of the at least one support frame 41 may be one. In this case, each of the first end 411 and the second end 412 of the support frame 41 may be arranged on a respective one of two sides of the frame body 1 and the base 2 which are diagonally opposite each other to stably support the frame body 1 and the base 2. The number of the at least one support frame 41 may also be two or more. In this case, both the first end 411 and the second end 412 of a same support frame 41 may be arranged on a same side of the frame body 1 and the base 2.

In particular, referring to FIG. 3, the number of the at least one support frame 41 may be two. The two support frames 41 may be accommodated in the placement chamber 102, and each of the two support frames 41 may support on a respective one of two opposite sides of the placement chamber 102. That is, each support frame 41 may be arranged on the same side of the frame body 1 and the base 2, and each of the two support frames 41 may be located on a respective one of two opposite sides of the frame body 1. The support frames 41 may be arranged in the placement chamber 102. When the towel heating barrel needs to be folded for storage, the support frames 41 may be directly rotated flat towards a middle portion of the placement chamber 102, thereby making the towel heating barrel more aesthetically pleasing and more convenient for storage.

Figure 4:
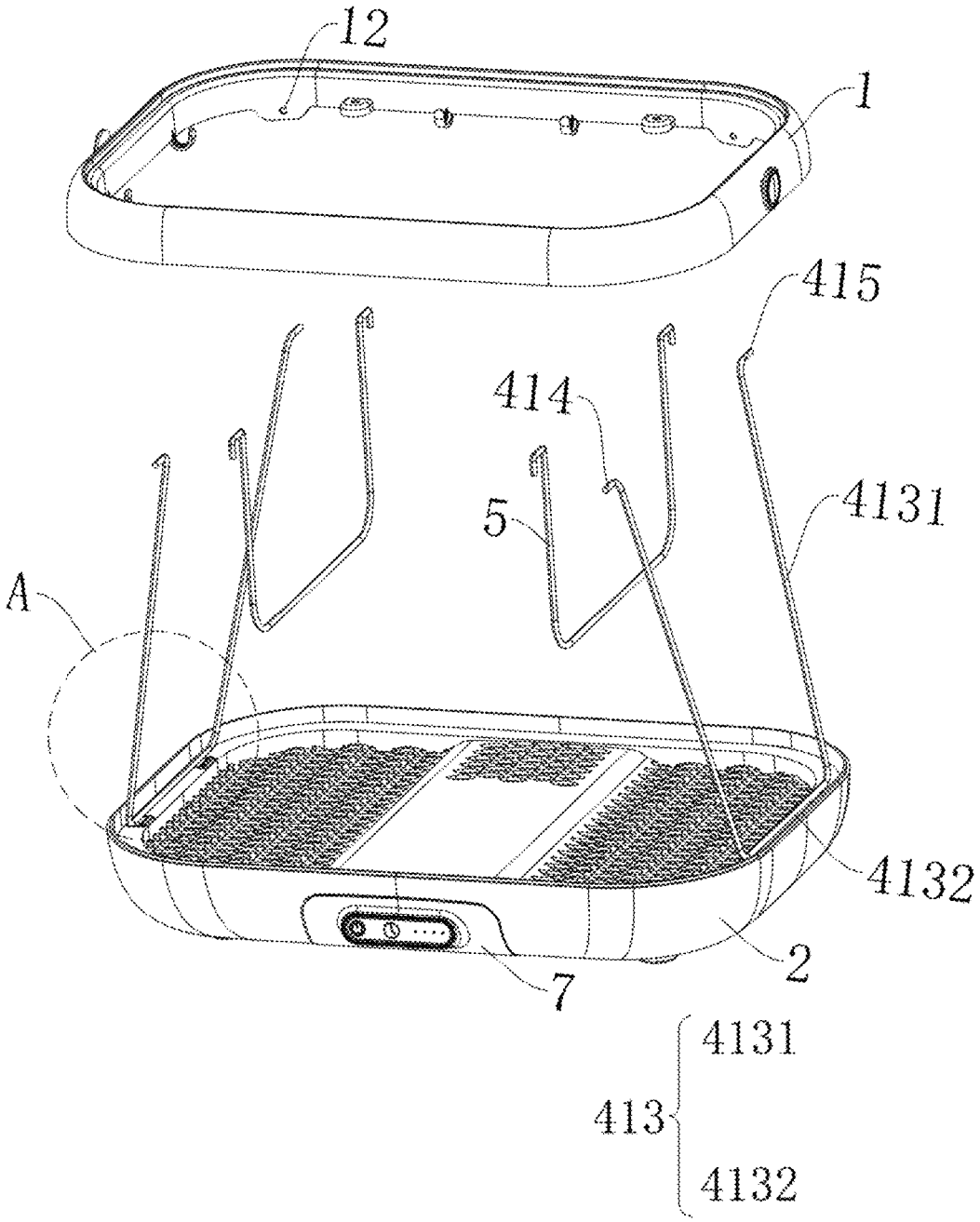
FIG. 4 is an exploded view of a partial structure of the towel heating barrel according to an embodiment of the present disclosure.
Figure 5:
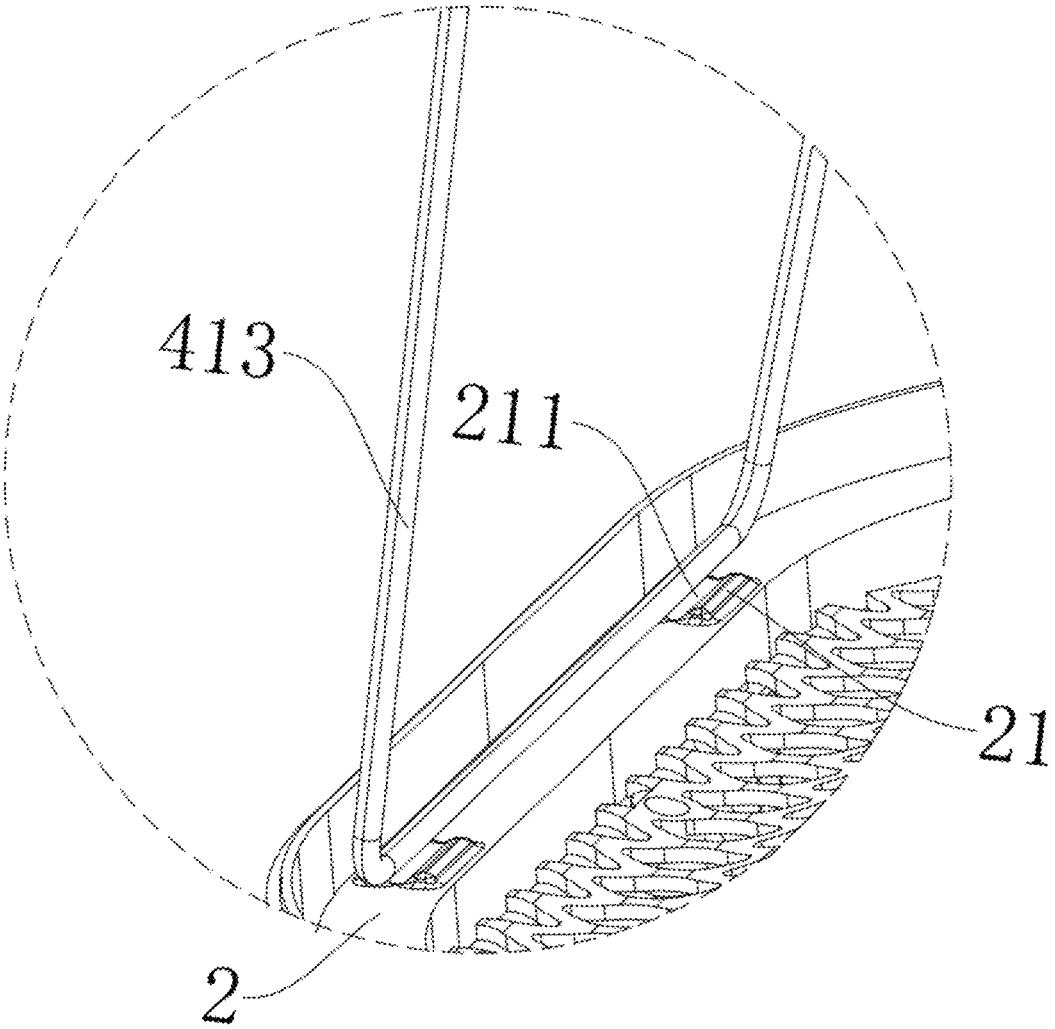
FIG. 5 is an enlarged view of a portion A in FIG. 4.

Referring to FIGS. 3 and 4, the support frame 41 may be made of a metal rod by bending the metal rod. The support frame 41 may include a U-shaped portion 413. The U-shaped portion 413 may be composed of two side rods 4131 and a bottom rod 4132. An end portion of one of the two side rods 4131 may extend away from the other of the two side rods 4131 to form a first connecting portion 414, and an end portion of the other of the two side rods 4131 may extend away from the one of the two side rods 4131 to form a second connecting portion 415. The frame body 1 may define two mounting holes 12 on two opposite sides with each mounting hole 12 on a respective one of the two opposite sides. Each of the first connecting portion 414 and the second connecting portion 415 may be rotatably arranged in a respective one of the two mounting holes 12. The base 2 may be arranged with a limiting block 21 at an edge of the base 2. The limiting block 21 may upwardly define a groove 211. The bottom rod 4132 may abut against the limiting block 21 and accommodated in the groove 211 of the limiting block 21, or may be taken out from the groove 211. The U-shaped structure of the support frame 41 may support the frame body 1 and the base 2 in both the vertical and horizontal directions, thereby making the towel heating barrel more stable after being unfolded.

Figure 7:
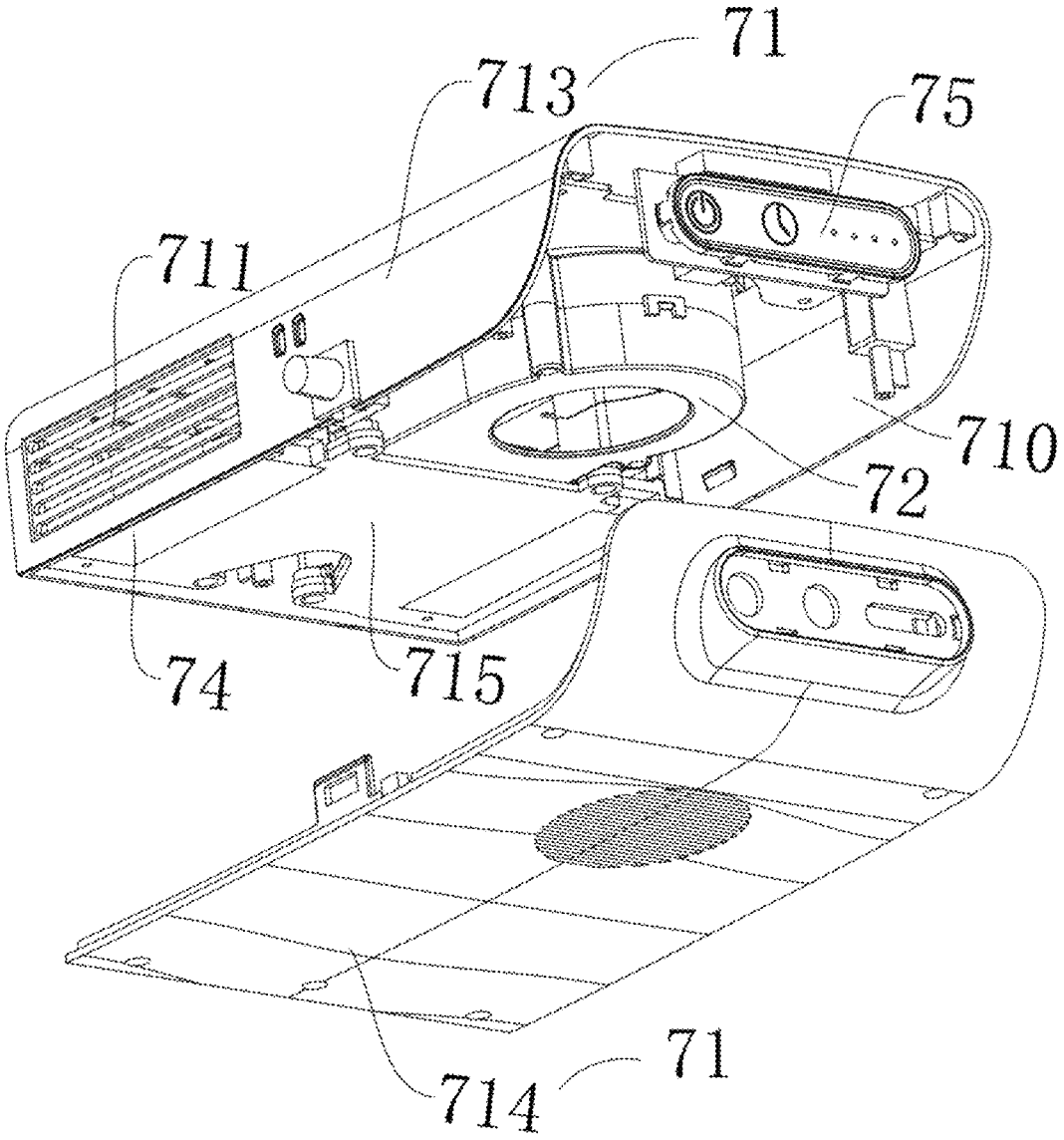
FIG. 7 is an exploded view of the air outlet mechanism according to an embodiment of the present disclosure.

Referring to FIGS. 6-7, the air outlet mechanism 7 may include a housing 71, a blower 72, and at least one heating element 74. The housing 71 may include an upper shell 713, a lower shell 714, and a partition plate 715. The upper shell 713 and the lower shell 714 may be combined to form a working chamber 710. The partition plate 715 may be arranged on a side of the upper shell 713 facing the lower shell 714. The partition plate 715 and the upper shell 713 may be combined to form an air cavity, that is, the air cavity may be located in the working chamber 710, and the air cavity may be used for air collection. The blower 72 may be accommodated in the working chamber 710, and an air outlet end of the blower 72 may be communicated with the air cavity to send air into the air cavity. The housing 71 may define at least one air outlet 711 communicated with the working chamber 710 and at least one air inlet 712 communicated with the working chamber 710. An air guide member 73 may be arranged in the air cavity to guide the airflow in the air cavity to flow towards the air outlet 711. The blower 72 may be a turbo fan. The heating element 74 may be arranged in the working chamber 710 or at the air outlet 711. The heating element 74 may heat the air in the working chamber 710 or heat the air blown out at the air outlet 711.

Referring to FIGS. 6-7, at least a portion of the base 2 may recess towards the placement chamber 102 to form a recess 231 with a downward opening. The base 2 may define at least one communication port 22. The communication port 22 may be communicated the placement chamber 102 with the recess 231. The housing 71 may be accommodated in the recess 231. The housing 71 may be flush or substantially flush with the recess 231 to facilitate placing the base 2 on a plane such as the ground. The air outlet 711 may be communicated with the communication port 22 of the base 2. Hot air may enter the placement chamber 102 via the air outlet 711 and the communication port 22. The heating element 74 may be a PDC heating frame. The recess 231 may include two recess walls 232 which may be arranged opposite each other. Two communication ports 22 may be formed on the two recess walls 232 with each communication port 22 formed on a respective one of the two recess walls 232. The air outlets 711 may be correspondingly provided as two. Each of the two air outlets 711 may be located on a respective one of both sides of the housing 71, and each of the two air outlets 711 may be arranged opposite to a respective one of the two communication ports 22. The housing 71 may be directly accommodated in the recess 231, allowing each air outlet 711 and the respective communication port 22 to directly face each other and to be communicated with each other, thereby simplifying an overall structure.

Referring to FIGS. 6 and 7, the air outlet mechanism 7 may further include a control panel 75 exposed from an outer side of the base 2. The control panel 75 may be electrically connected to the blower 72 and the heating element 74. The control panel 75 may be arranged with control buttons and indicator lights to facilitate user control and viewing of working modes of the blower 72 and the heating element 74.

Figure 8:
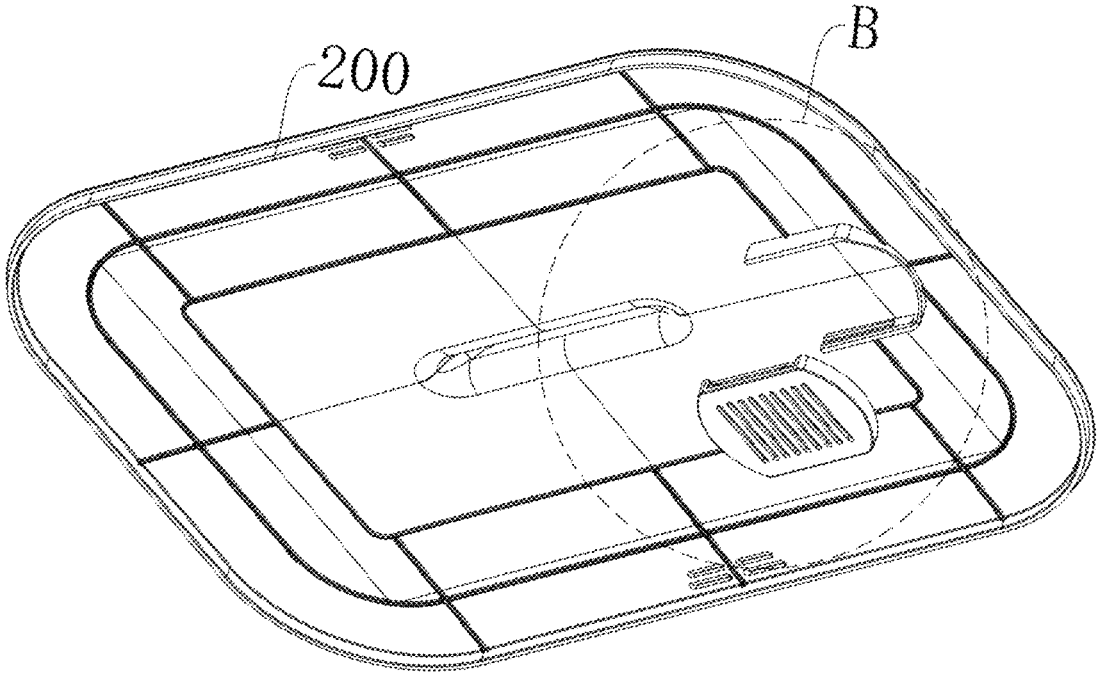
FIG. 8 is an exploded view of a fragrance box according to an embodiment of the present disclosure.
Figure 9:
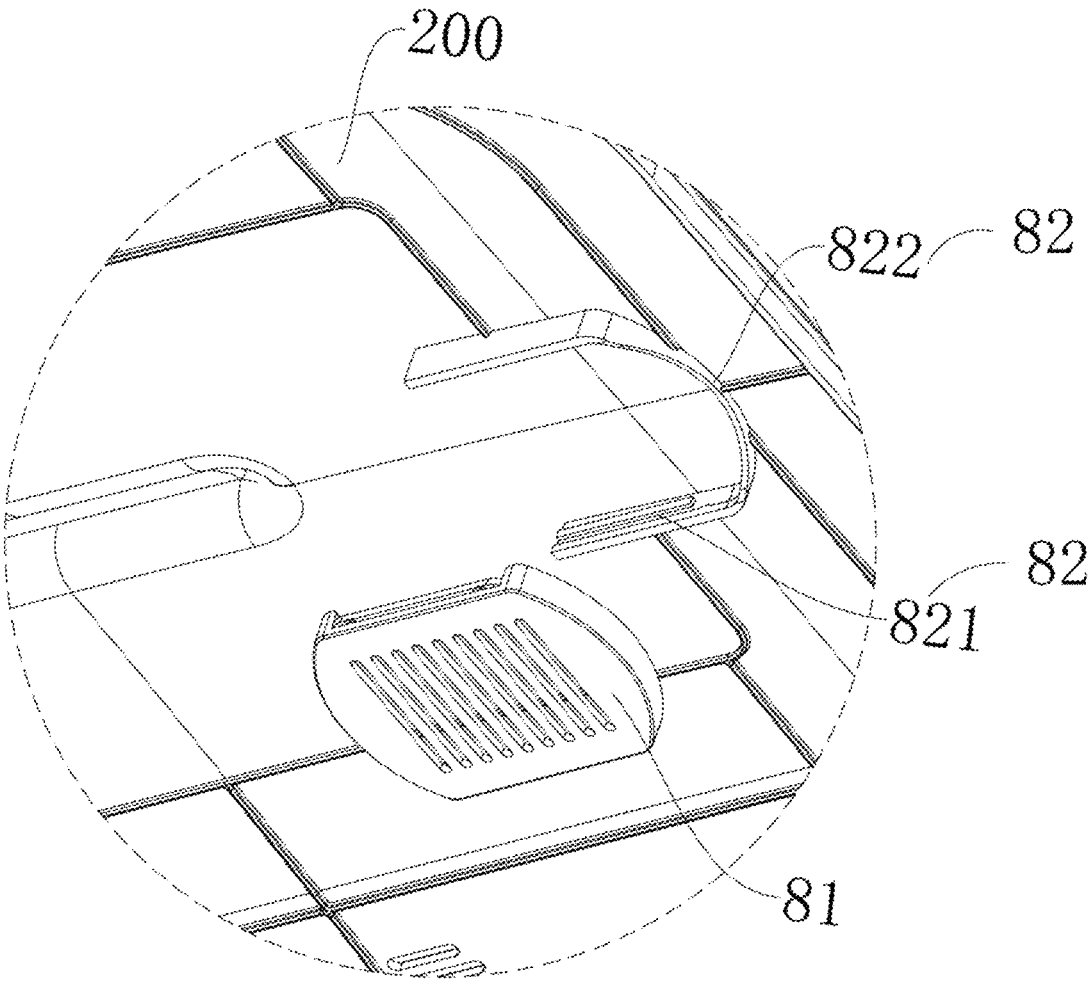
FIG. 9 is an enlarged view of a portion B in FIG. 8.
Figure 9:
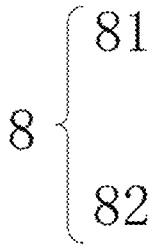
Figure 10:
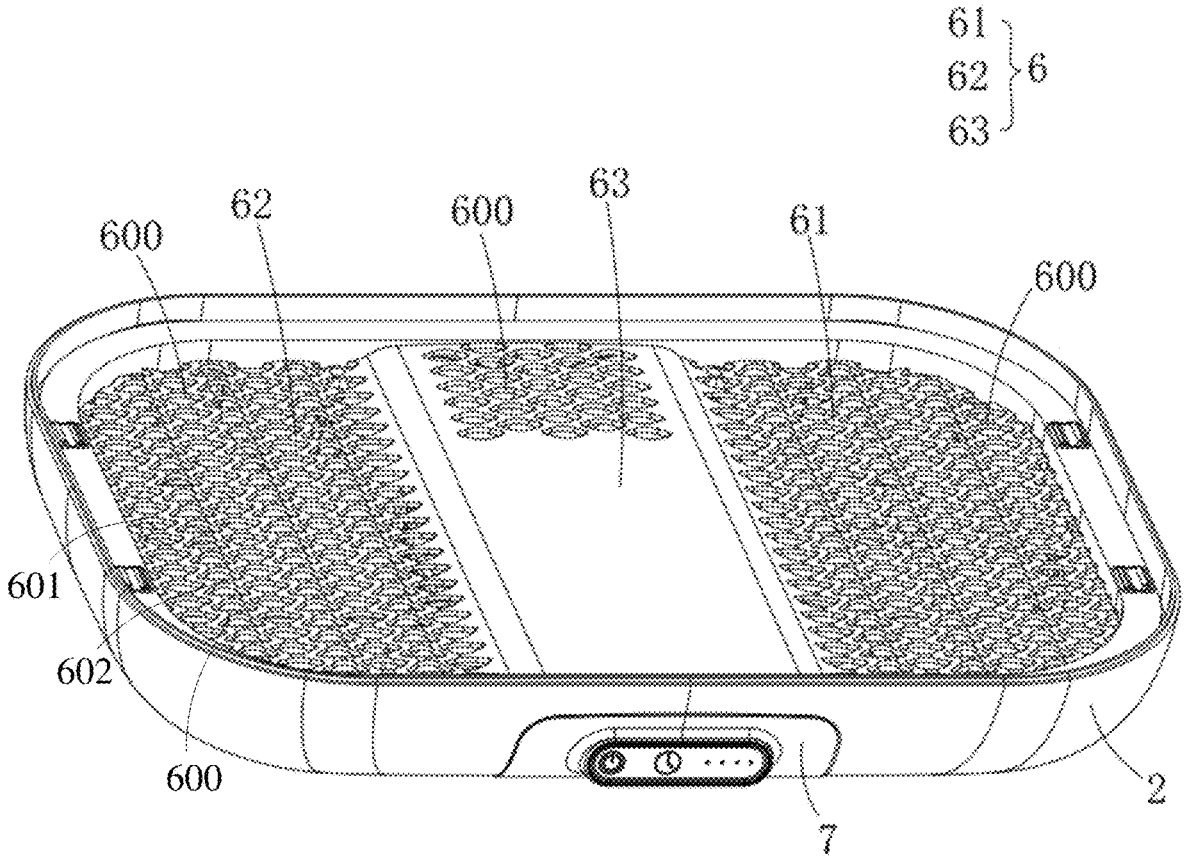
FIG. 10 is a structural view of the base and an air outlet plate according to an embodiment of the present disclosure.

In one embodiment of the present disclosure, referring to FIGS. 8 and 9, the towel heating barrel further may include a cover 200 and a fragrance box 8. The cover 200 may be detachably arranged on the frame body 1 to cover the opening 11. The cover 200 may be arranged with a handle to facilitate the user to grip and lift the cover 200 up. When heating items such as towels, the cover 200 may close the opening 11, which can ensure airtightness of hot air circulation in the towel heating barrel, preventing heat loss. The fragrance box 8 may include a box body 81 and a slide rail 82. The slide rail 82 may be arranged on a side of the cover 200 facing the placement chamber 102. The slide rail 82 may include two guide rails 821 symmetrically distributed on an inner side of the cover 200, and an arc portion 822 connected the two guide rails 821. The box body 81 may be engaged with the two guide rails 821 and may slide along the two guide rails 821 to achieve a horizontal push-pull opening and closing. A height of the arc portion 822 may be lower than heights of the guide rails 821, forming a gap at an end portion of the arc portion 822, which may facilitate the user to slide and push open the box body 81 from the gap of the arc portion 822. The box body 81 may be arranged with a hollow or mesh bottom to facilitate fragrance diffusion. The box body 81 may store fragrance sheets, spices, etc. The hot air in the placement chamber 102 may form forced convection through the hollow or mesh bottom, accelerating diffusion of fragrance molecules to surfaces of items such as towels in the towel heating barrel, enhancing deodorizing, sterilizing, or freshening effects.

Figure 1:
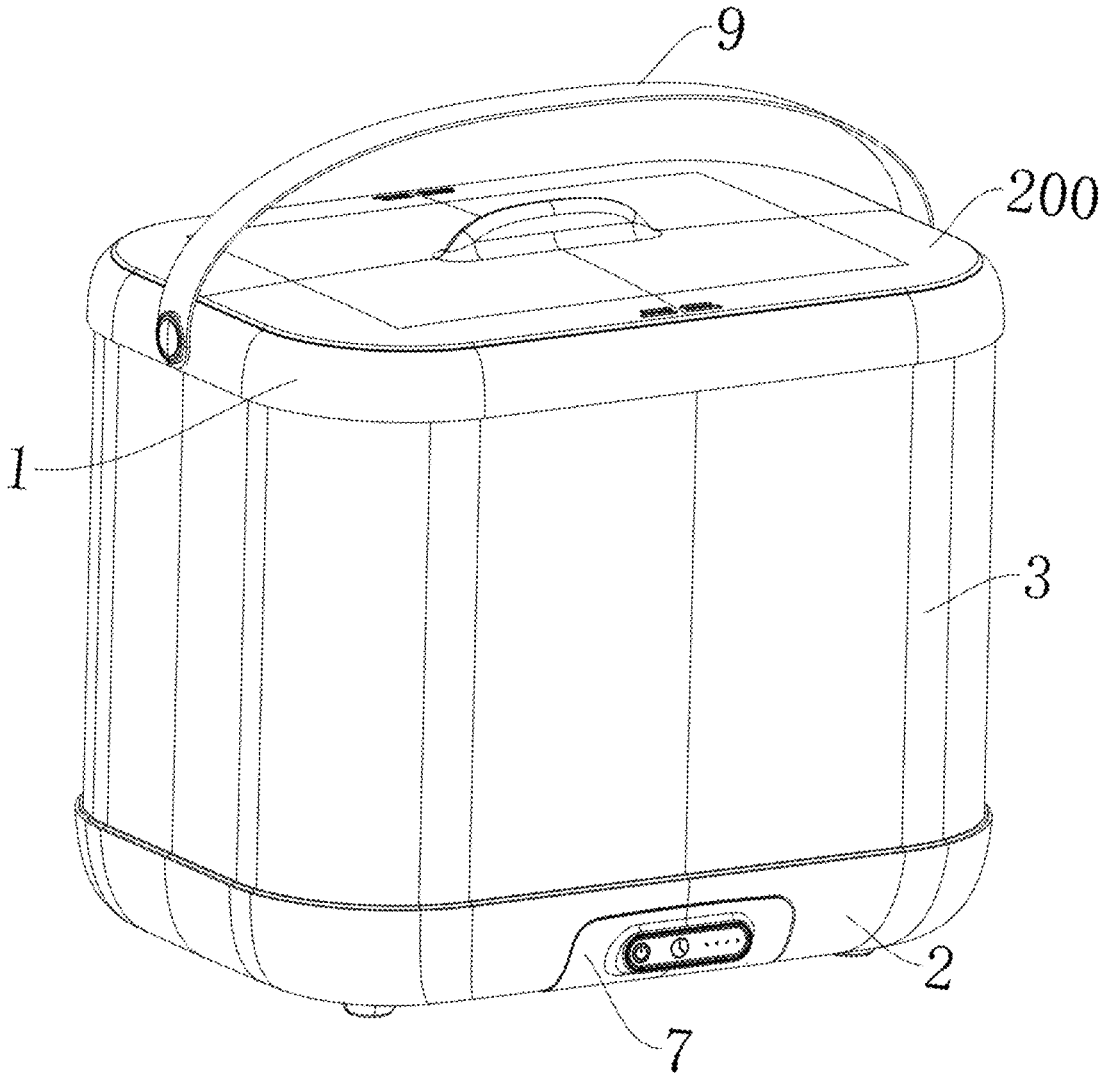
FIG. 1 is a structural view of a towel heating barrel according to an embodiment of the present disclosure.
Figure 2:
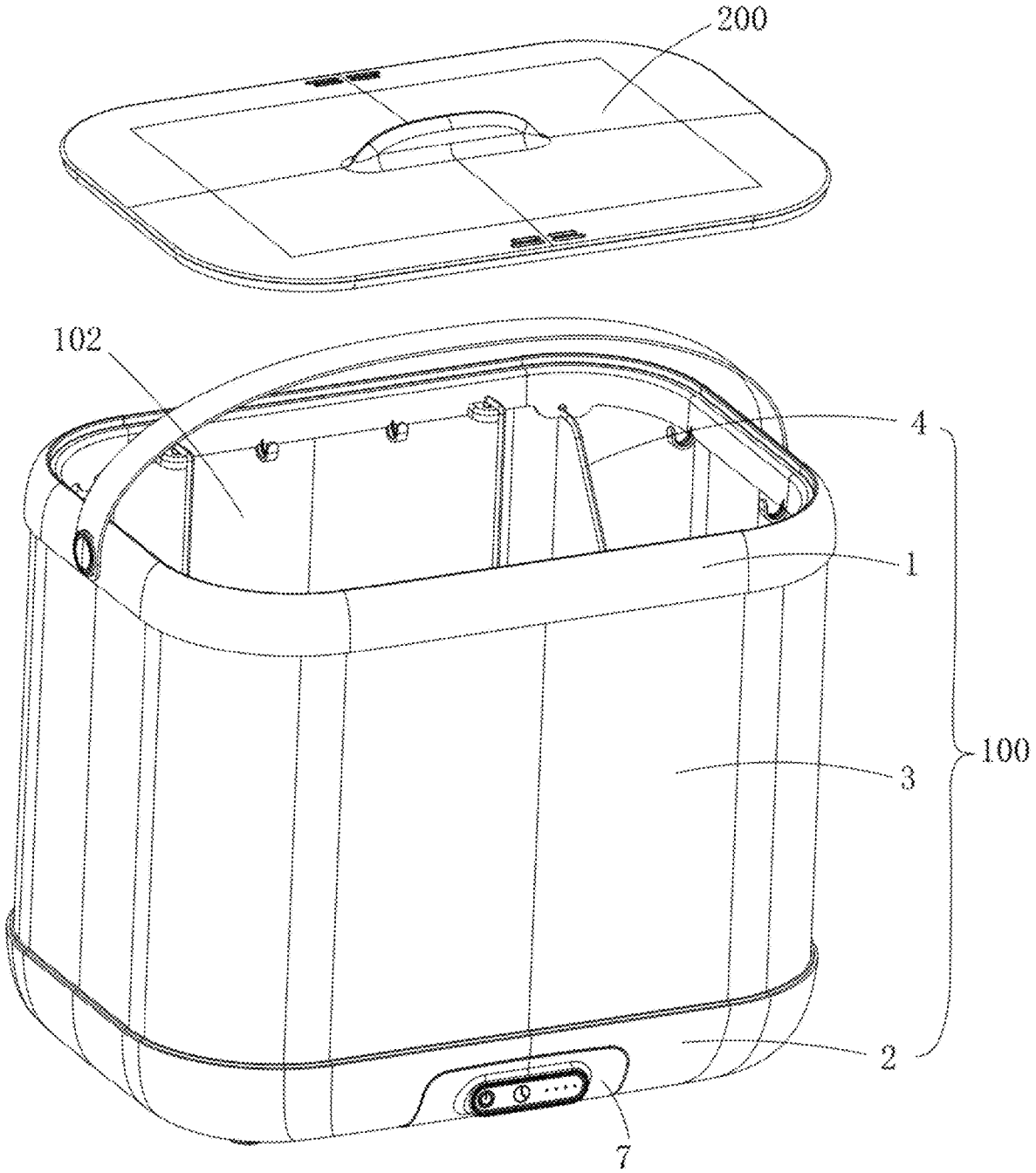
FIG. 2 is a partially exploded view of the towel heating barrel according to an embodiment of the present disclosure.

In one embodiment of the present disclosure, referring to FIG. 1, the towel heating barrel may further include a handle 9. The handle 9 can be arranged on the frame body 1 by means of snap-fit, screws, welding, riveting, etc., or the handle 9 and the frame body 1 are integrally formed by injection molding as a one-piece structure. In this way, the user can be facilitated to pick up and place the towel heating barrel.

Referring to FIGS. 10 to 18, the towel heating barrel provided by the present disclosure may further include an air outlet plate 6. An air chamber 101 may be formed in the base 2. The air outlet plate 6 may be mounted in the base 2 and may separate the air chamber 101 and the placement chamber 102. A plurality of ventilation holes 600 may be formed on the air outlet plate 6, and the air chamber 101 may be communicated with the placement chamber 102 via the ventilation holes 600. The air outlet mechanism 7 may draw air from outside the barrel body 100 and blow the air into the air chamber 101 after heating the air. Then, the air may flow to enter the placement chamber 102 through the ventilation holes 600 to heat and dry items such as towels and underwear in the placement chamber 102.

Figure 12:
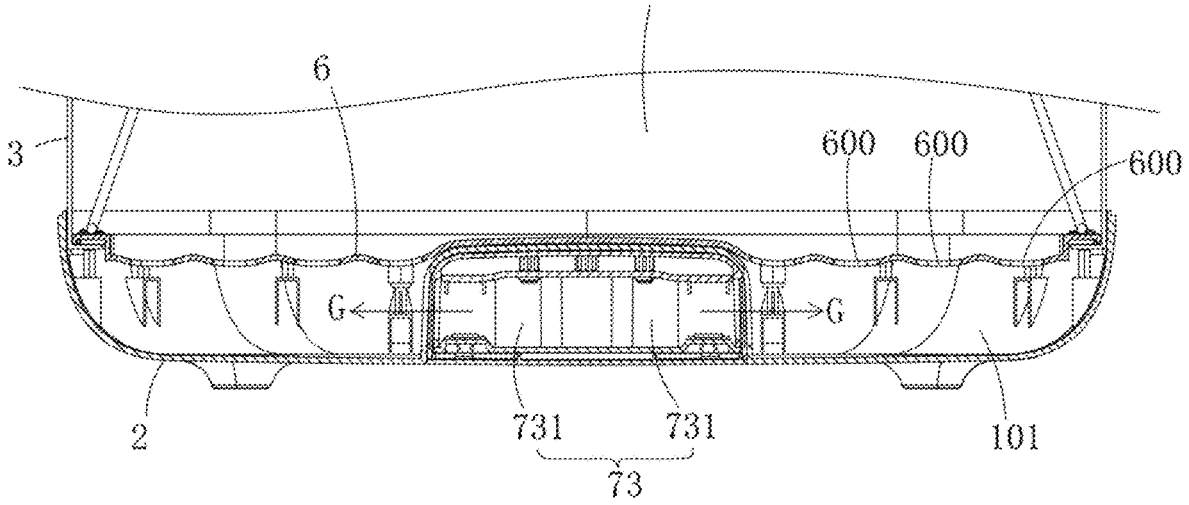
FIG. 12 is a cross-sectional view of the partial structure of the towel heating barrel according to an embodiment of the present disclosure.

An air blowing direction G of the air outlet mechanism 7 may form an angle with the vertical direction, or as shown in FIG. 12, the air blowing direction G of the air outlet mechanism 7 may be parallel to the horizontal direction. In other words, the air outlet mechanism 7 may provide horizontal or inclined air outlet, which may give the airflow entering the air chamber 101 a larger distribution area in the horizontal direction. Since the air outlet mechanism 7 blows air into the air chamber 101, an air pressure in the air chamber 101 may become greater than an air pressure in the placement chamber 102. Therefore, the air blown into the air chamber 101 may rise into the placement chamber 102, thereby blowing on the towels. A wind-receiving area of the towels may be larger compared to a situation where the air outlet mechanism 7 blows directly on the towels, and a heat distribution in the placement chamber 102 may be more uniform, resulting in better drying and heating effects on the towels.

Figure 14:
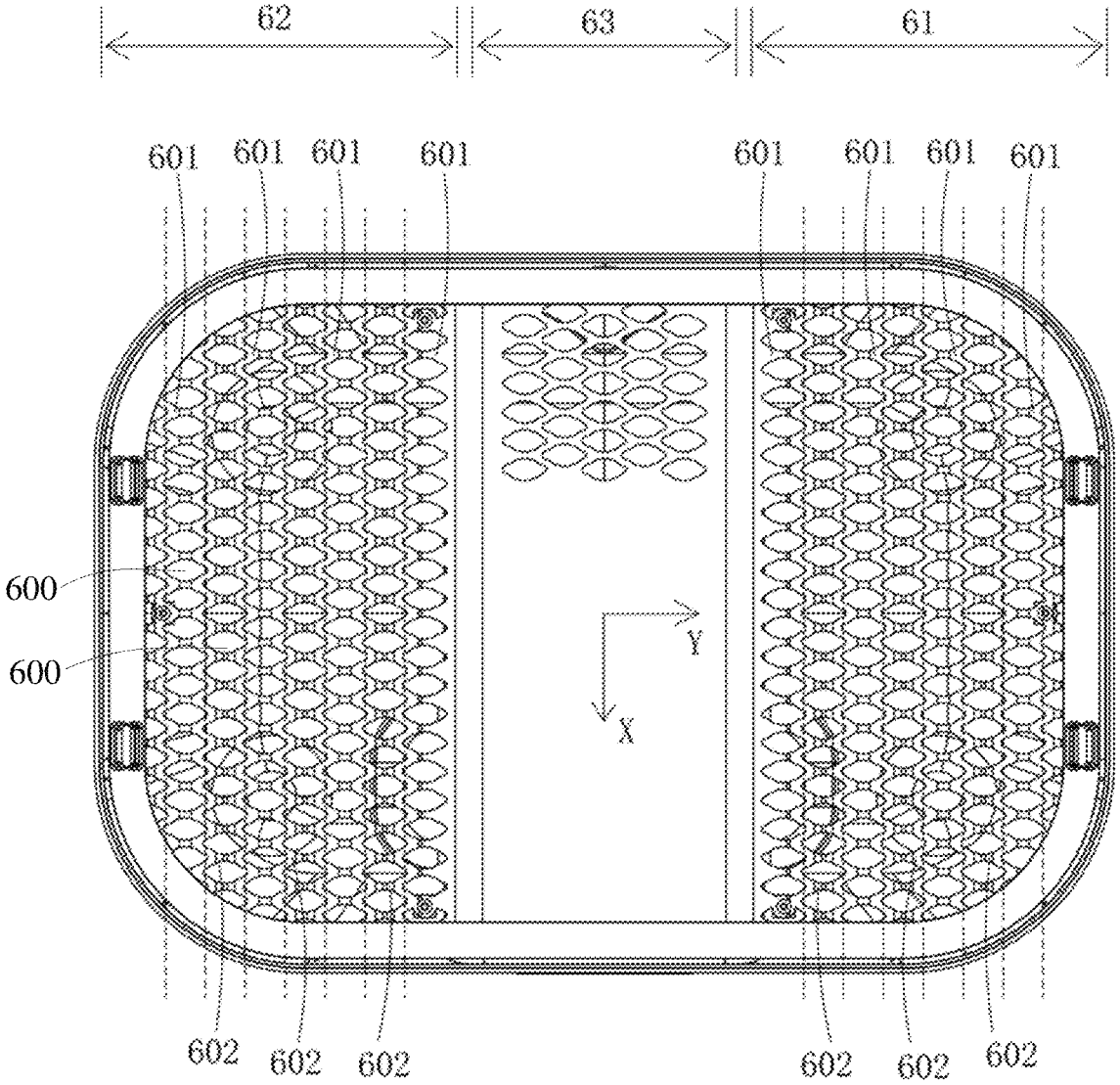
FIG. 14 is a top view of the air outlet plate according to an embodiment of the present disclosure.

In some embodiments, the air outlet plate 6 may include a plurality of concave portions 601 and a plurality of convex portions 602. Each of the plurality of concave portions 601 and the plurality of convex portions 602 may extend in a first direction X. The first direction X may be consistent with a width direction of the base 2. The plurality of concave portions 601 and the plurality of convex portions 602 may be alternately distributed and connected in a second direction Y. The first direction Y may be consistent with a length direction of the base 2. The first direction X and the second direction Y may be perpendicular to each other, as shown in FIG. 14. In this way, at least part of the air outlet plate 6 may be arranged with a wavy structure. Peak parts of this wavy structure may correspond to the convex portions 602, and trough parts of the wavy structure may correspond to the concave portions 601. This structure allows a part of the airflow in the air chamber 101 to flow and diffuse along an extension direction of the concave portions 601, i.e., diffuse in the first direction X along the concave portions 601, facilitating an expansion of an air outlet area of the air outlet plate 6.

Figure 13:
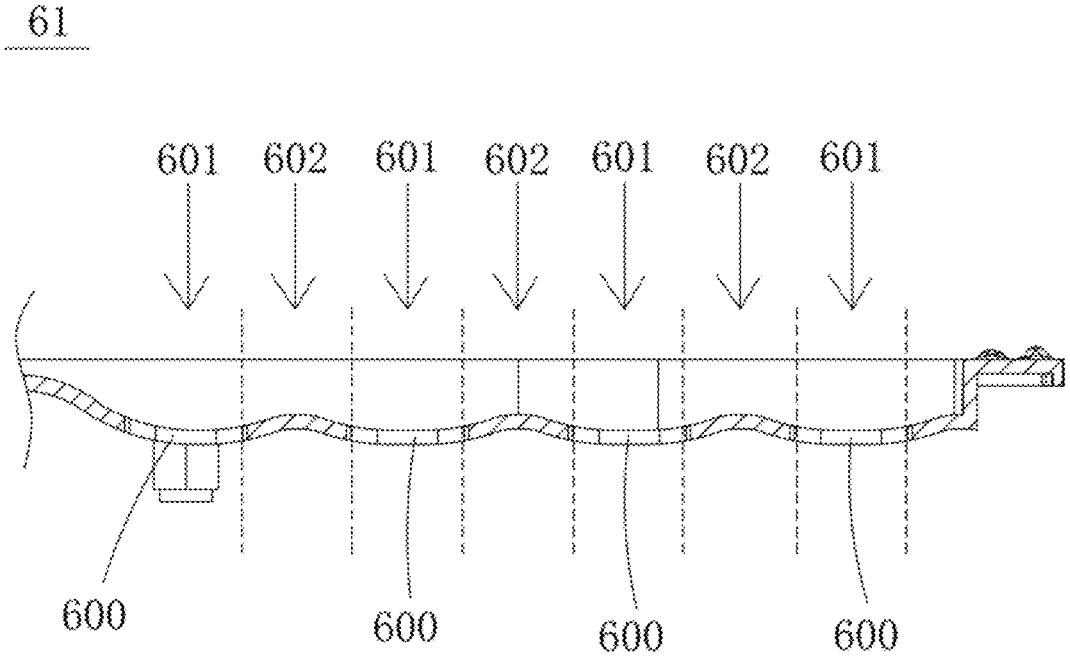
FIG. 13 is a cross-sectional view of a first corrugated portion according to an embodiment of the present disclosure.

As shown in FIGS. 13-14, each of the concave portions 601 and the convex portions 602 may define a plurality of ventilation holes 600. The ventilation holes 600 can be used to disperse a rising airflow passing through the ventilation holes 600, utilizing the wavy air outlet plate 6. In a case where the air outlet plate 6 is a flat plate, the rising airflow may form a straight jet, resulting in limited improvement in a wind-receiving range of the towels. In this embodiment, the wavy design of the air outlet plate 6 may allow heights of ventilation holes 600 on the air outlet plate 6 to be different with each other and simultaneously allow jet angles of the rising airflow passing through the ventilation holes 600 to be different with each other, causing jets from different positions to mutually overlap and shear in space, thereby forming a uniformly distributed airflow in the placement chamber 102. The wind-receiving area of the towels may be greatly increased, meaning a drying and heating effect on the towels may be better.

Specifically, the first direction X may be perpendicular to the air blowing direction G of the air outlet mechanism 7, the second direction Y may be parallel to the air blowing direction G of the air outlet mechanism 7, and both the first direction X and the second direction Y may be horizontal directions. That is, the air outlet plate 6 may be a plate which is horizontally arranged, and the air outlet plate 6 as a whole may be substantially parallel to the air blowing direction G of the air outlet mechanism 7, so that the airflow diffusing along the concave portions 601 may spread more evenly to both sides.

In some embodiments, as shown in FIGS. 13-14, each ventilation hole 600 on the concave portion 601 may be formed at a lowest portion of the concave portion 601, and each ventilation hole 600 on the convex portion 602 may be formed at a highest portion of the convex portion 602, thereby creating height differences between the various ventilation holes 600. The plurality of ventilation holes 600 on the concave portion 601 may be uniformly distributed at equal intervals in the first direction X, and the plurality of ventilation holes 600 on the convex portion 602 may be uniformly distributed at equal intervals in the first direction X. Meanwhile, taking one concave portion 601 and one convex portion 602 which are adjacent to each other as an example, the plurality of ventilation holes 600 on the concave portion 601 and the plurality of ventilation holes 600 on the convex portion 602 may be also staggered in the first direction X, therefore causing the ventilation holes 600 on the concave portion 601 and the ventilation holes 600 on the convex portion 602 to be staggered in the second direction Y as well. In this way, the plurality of ventilation holes 600 may be uniformly distributed on the wavy air outlet plate 6. Furthermore, the wavy structure of the air outlet plate 6 may be utilized to create a pressure difference distribution on a surface of the air outlet plate 6, forming local vortices on a side of the concave portions 601 and convex portions 602 facing the air chamber 101. This flow-around effect may increase a dispersion of the airflow after passing through the ventilation holes 600.

In some embodiments, as shown in FIGS. 13-14, the ventilation holes 600 may be in a shape that may be wide in the middle and narrow on both sides, for example, the ventilation holes 600 may be diamond-shaped. For the ventilation holes 600 formed on the convex portion 602, each of two ends of each ventilation hole 600 may be close to or extend to a respective one of two adjacent concave portions 601. The ventilation holes 600 on the convex portion 602 may be high in the middle and low on both sides, while the ventilation holes 600 on the concave portion 601 may be low in the middle and high on both sides, so that each ventilation hole 600 itself has a height difference. In this way, when airflow enters the placement chamber 102 from the diamond-shaped ventilation holes 600, the airflow may form a jet with a deflection angle, and the jets from adjacent ventilation holes 600 may cross and counterflow against each other.

Figure 15:
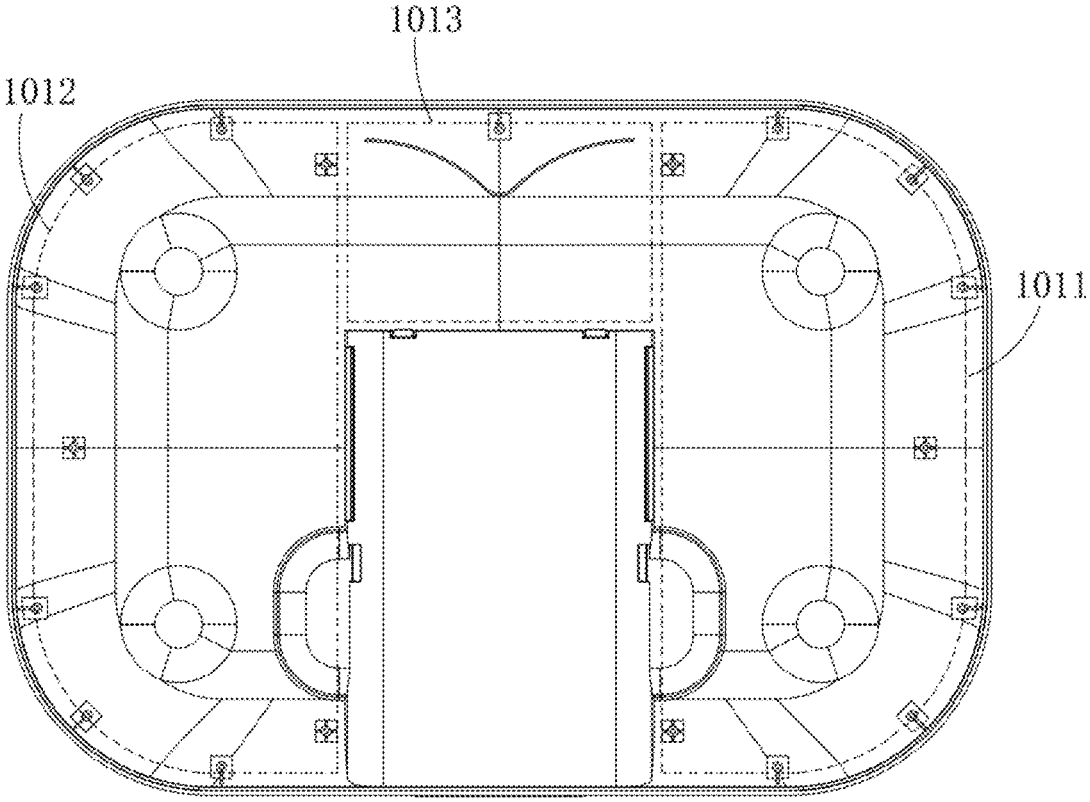
FIG. 15 is a first top view of the base according to an embodiment of the present disclosure.
Figure 16:
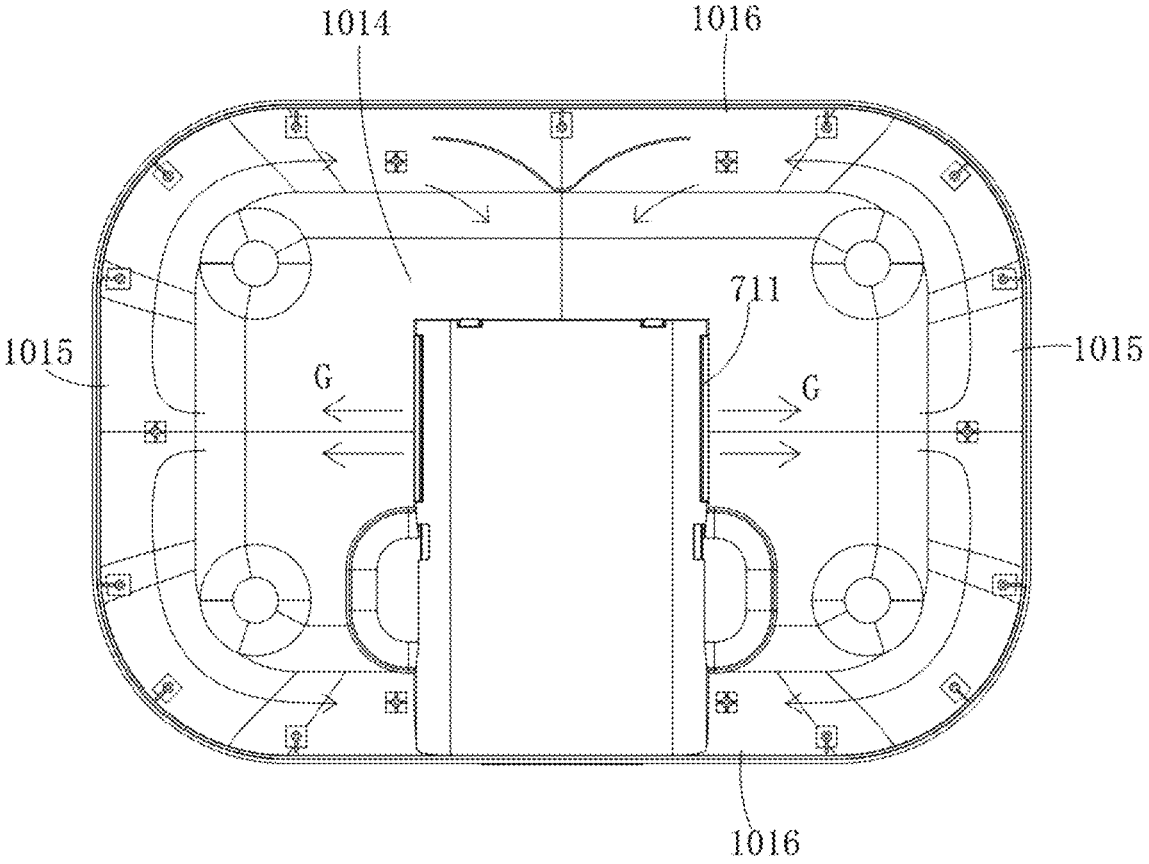
FIG. 16 is a second top view of the base according to an embodiment of the present disclosure.

In some embodiments, as shown in FIGS. 15 and 16, the air chamber 101 may include a first chamber 1011 and a second chamber 1012 which may be distributed in the horizontal direction. The air outlet mechanism 7 may be located between the first chamber 1011 and the second chamber 1012, and the air outlet mechanism 7 may define two air outlets 711 which are opposite with each other. Each of the two air outlets 711 may be communicated with a respective one of the first chamber 1011 and the second chamber 1012. The air outlet mechanism 7 may blow air into the first chamber 1011 and the second chamber 1012 respectively through the two air outlets 711, thereby reducing an airflow intensity at each air outlet 711 and further expanding an air outlet area of the air outlet plate 6.

Figure 17:
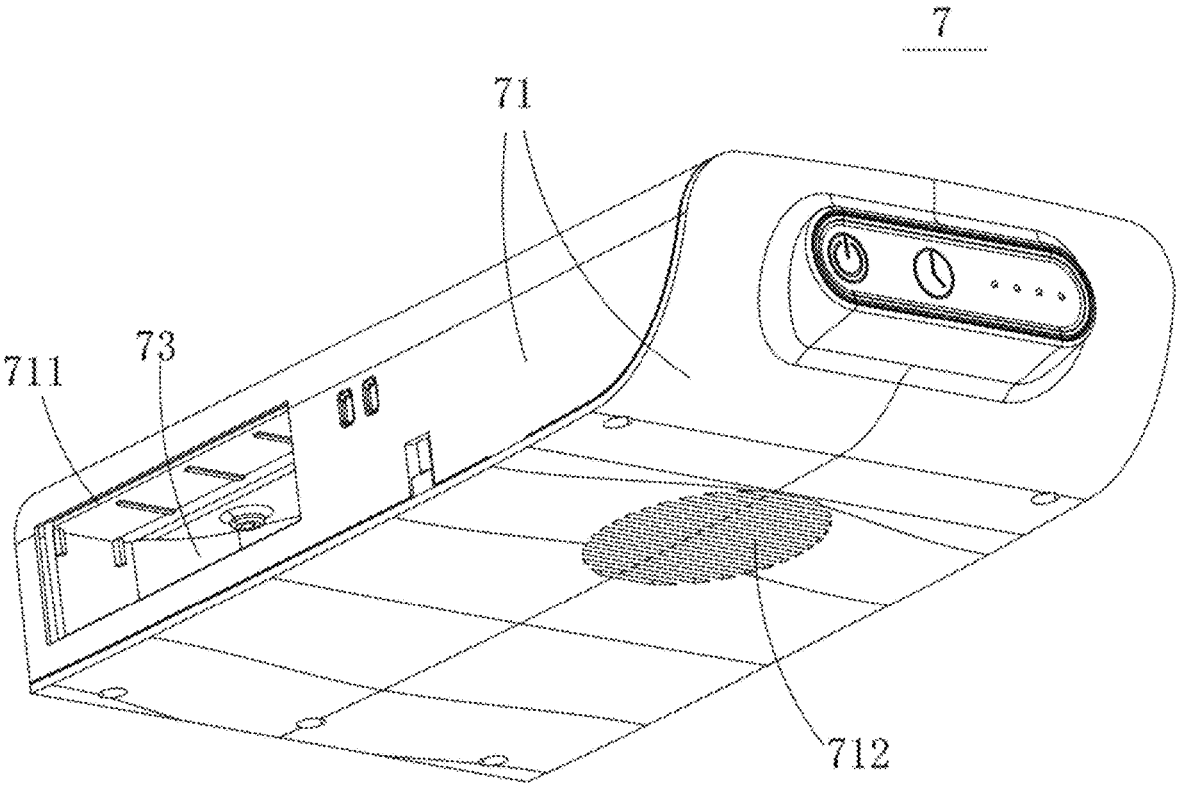
FIG. 17 is a structural view of the air outlet mechanism according to an embodiment of the present disclosure.
Figure 18:
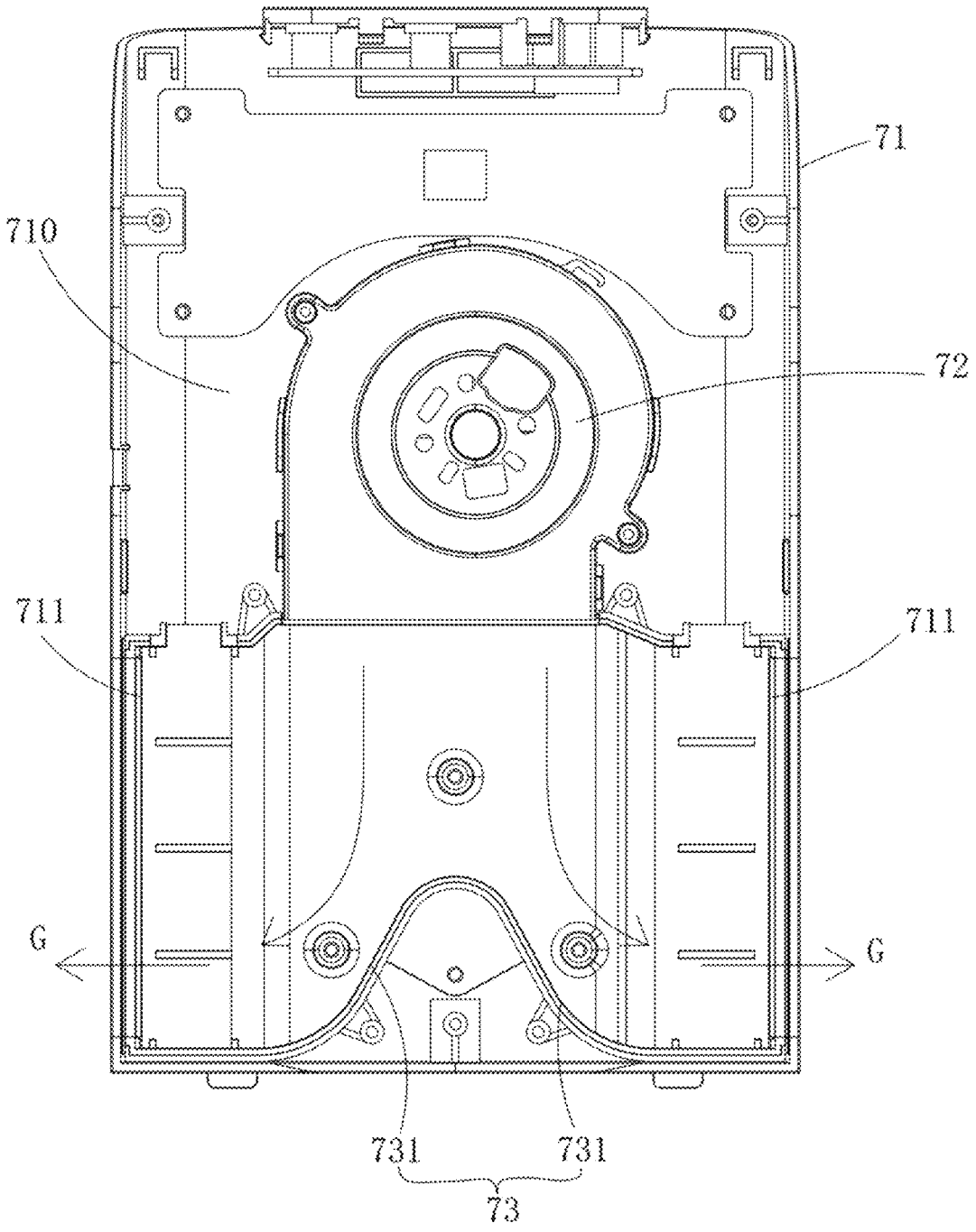
FIG. 18 is a cross-sectional view of the air outlet mechanism according to an embodiment of the present disclosure.

Specifically, referring to FIGS. 17 and 18, each of the blower 72 and the air guide member 73 may be located in the working chamber 710. The blower 72 may draw air from the air inlet 712 and, after heating the air, blow the air in the first direction X towards the air guide member 73. The air guide member 73 may include two air guide portions 731 connected with each other. Each of the two air guide portions 731 may extend inclinedly towards a respective one of the two air outlets 711, used to divide the airflow blown by the blower 72 into two even parts and guide a corresponding part to the a respective one of the two air outlets 711.

To make the airflow from the two air outlets 711 lie on a same straight line direction, each of the two air guide portions 731 may be arranged in an arc shape, and an end portion of each air guide portion 731 close to a respective air outlet 711 may be approximately arranged along the second direction Y. In this way, the airflow blown out from the two air outlets 711 may be parallel to each other or lie on a same straight line, that is, both air outlets 711 may blow air along the second direction Y.

In some embodiments, as shown in FIG. 16, a bottom wall 1014, two first inner walls 1015, and two second inner walls 1016 cooperatively define the air chamber 101. Each of the two first inner walls 1015 may be arranged opposite to a respective one of the two air outlets 711, that is, the two first inner walls 1015 may be opposite in the second direction Y. The two second inner walls 1016 may be opposite in the first direction X. The bottom wall 1014 and each of the first inner walls 1015 may be connected with each other by a radius for a smooth transition. The bottom wall 1014 and each of the second inner walls 1016 may be connected with each other by a radius for a smooth transition. Each first inner wall 1015 and an adjacent second inner wall 1016 may be connected with each other by a radius for a smooth transition.

From the air outlet 711, a portion of the airflow may rise directly and pass through the ventilation holes 600, another portion of the airflow may impinge on the first inner walls 1015, diverge radially along the first inner walls 1015, and may be guided to the second inner walls 1016, where the airflow exits through the ventilation holes 600 close to the second inner walls 1016, thereby effectively expanding an overall airflow coverage area of the air outlet plate 6.

Figure 11:
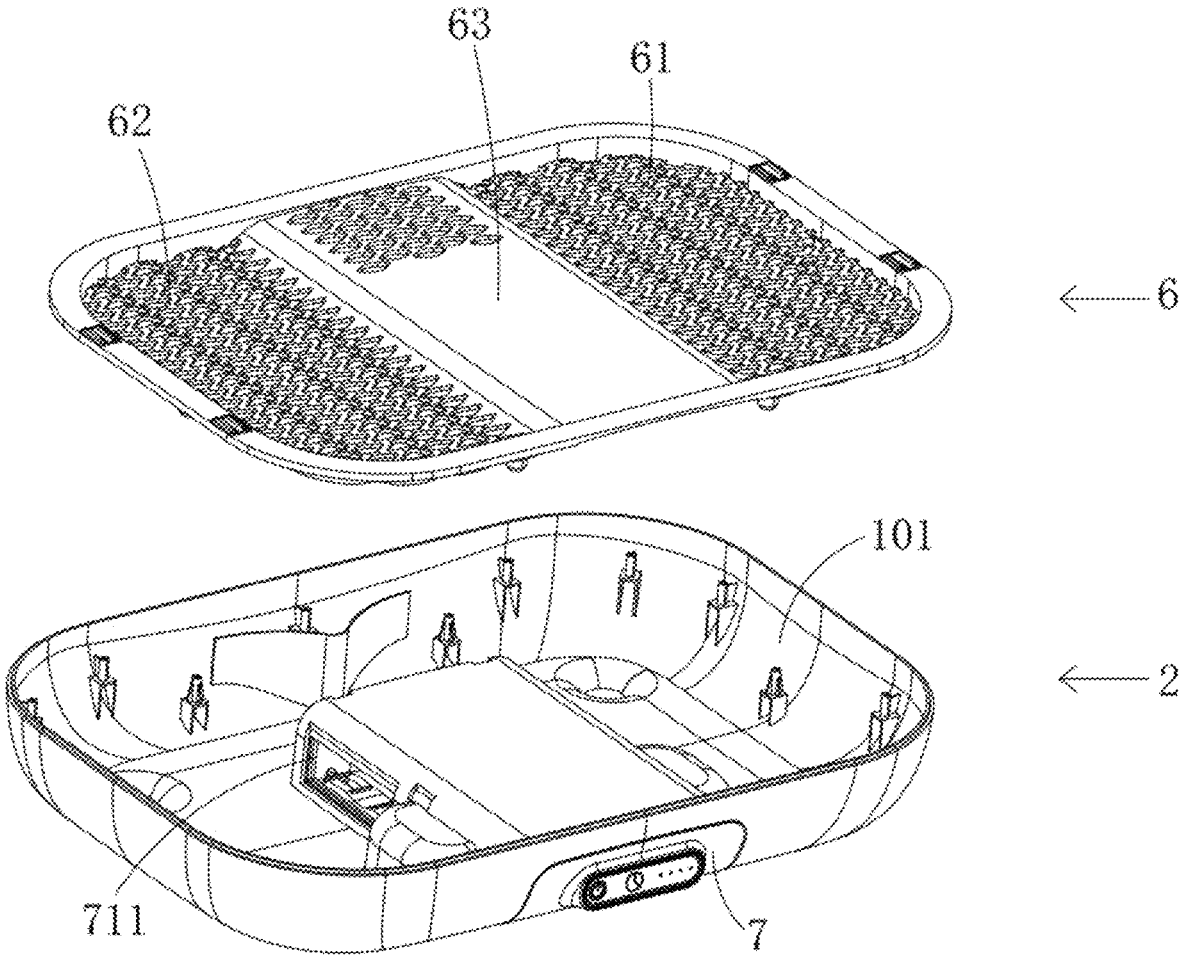
FIG. 11 is an exploded view of the base and the air outlet plate according to an embodiment of the present disclosure.

In some embodiments, as shown in FIGS. 11 and 15, the air chamber 101 may further include a third chamber 1013. The third chamber 1013 may be communicated with each of the first chamber 1011 and the second chamber 1012. The third chamber 1013 may be located between the first chamber 1011 and the second chamber 1012, and the air outlet mechanism 7 may be located in the third chamber 1013. The air outlet plate 6 may include a first corrugated portion 61, a second corrugated portion 62, and a connecting plate 63. The first corrugated portion 61 may be located above the first chamber 1011, the second corrugated portion 62 may be located above the second chamber 1012, and each of the first corrugated portion 61 and the second corrugated portion 62 may be connected to a respective one of two opposite sides of the connecting plate 63. That is, the connecting plate 63 may be connected between the first corrugated portion 61 and the second corrugated portion 62, and the connecting plate 63 may be located above the air outlet mechanism 7 and the third chamber 1013. Each of the first corrugated portion 61 and the second corrugated portion 62 may include a plurality of concave portions 601 and a plurality of convex portions 602. The connecting plate 63 may define a plurality of ventilation holes 600 only above an area of the third chamber 1013 that is not covered by the air outlet mechanism 7.

Specifically, the third chamber 1013 may collect the airflow recirculated from the second inner walls 1016. The collected air may then be directed through the ventilation holes 600 in the connecting plate 63, thereby further increasing both an airflow area and efficiency of the air outlet plate 6.

In some embodiments, as shown in FIGS. 3-4, the towel heating barrel may further include at least two hanging rods 5. The hanging rods 5 may be fixedly or movably mounted to the frame body 1 and arranged in the placement chamber 102. Each of two of the hanging rods 5 may be located above a respective one of the first chamber 1011 and the second chamber 1012. Towels can be placed on the hanging rods 5. Since the air in the placement chamber 102 is dynamic above the first chamber 1011 and the second chamber 1012, this arrangement of the hanging rods 5 may ensure that towels are positioned directly in the active airflow zones.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

The invention claimed is:

1. A towel heating barrel, comprising:

a frame body, defining an opening;

a base;

an enclosing member, flexible and arranged between the frame body and the base, wherein the enclosing member, the frame body, and the base cooperatively define a placement chamber, and the opening is communicated with the placement chamber; and a support member, movably arranged between the frame body and the base, configured to enable the frame body and the base to move close to or away from each other and enable the enclosing member to be folded or unfolded;

wherein the support member comprises at least one support frame, the at least one support frame comprises a first end and a second end, the first end is rotatably connected to one of the frame body and the base, and the second end is detachably connected to the other of the frame body and the base.

2. The towel heating barrel according to claim 1, wherein the number of the at least one support frame is two, the two support frames are accommodated in the placement chamber, and each of the two support frames supports on a respective one of two opposite sides of the placement chamber.

3. The towel heating barrel according to claim 1, wherein the support frame comprises a U-shaped portion, a first connecting portion, and a second connecting portion, and each of the first connecting portion and the second connecting portion extends outward from a respective one of two ends of the U-shaped portion;

the frame body defines mounting holes, each of the first connecting portion and the second connecting portion is rotatably arranged in a corresponding one of the mounting holes, the base is arranged with a limiting block, and the U-shaped portion detachably abuts against the limiting block.

4. The towel heating barrel according to claim 1, further comprising an air outlet mechanism, wherein the air outlet mechanism is mounted in the placement chamber and is configured to generate hot air and blow the hot air to the placement chamber.

5. The towel heating barrel according to claim 4, wherein the air outlet mechanism comprises:

a housing, defining a working chamber, at least one air outlet, and at least one air inlet, wherein the working chamber is communicated with each of the at least one air outlet and at least one air inlet;

a blower, arranged in the working chamber, configured to draw air from the at least one air inlet and blow the air towards the at least one air outlet; and at least one heating element, arranged in the working chamber or at the at least one air outlet.

6. The towel heating barrel according to claim 1, further comprising a cover and a fragrance box, wherein the cover is configured to cover or open the opening of the frame body, the fragrance box comprises a box body and a slide rail, the slide rail is arranged on a side of the cover facing the placement chamber, and the box body is slidably connected to the slide rail.

7. The towel heating barrel according to claim 4, wherein the base defines an air chamber, the towel heating barrel further comprises an air outlet plate, the air outlet plate is mounted in the base and separates the air chamber and the placement chamber, the air outlet plate defines a plurality of ventilation holes, and the air chamber and the placement chamber are communicated with each other via the plurality of ventilation holes;

an air blowing direction of the air outlet mechanism forms an angle with a vertical direction, or the air blowing direction of the air outlet mechanism is parallel to a horizontal direction.

8. The towel heating barrel according to claim 7, wherein the air outlet plate comprises a plurality of concave portions and a plurality of convex portions, each of the plurality of concave portions and the plurality of convex portions extends in a first direction, and the plurality of concave portions and the plurality of convex portions are alternately distributed and connected in a second direction; the first direction is perpendicular to the second direction, and each of the plurality of concave portions and the plurality of convex portions defines the plurality of ventilation holes.

9. The towel heating barrel according to claim 8, wherein the first direction is perpendicular to the air blowing direction of the air outlet mechanism, the second direction is parallel to the air blowing direction of the air outlet mechanism, and each of the first direction and the second direction is the horizontal direction;

the plurality of ventilation holes on each of the plurality of concave portions and the plurality of convex portions are distributed at intervals in the first direction.

10. The towel heating barrel according to claim 8, wherein each of the plurality of ventilation holes on the plurality of concave portions is formed at a lowest portion of a corresponding one of the plurality of concave portions, and each of the plurality of ventilation holes on the plurality of convex portions is formed at a highest portion of a corresponding one of the plurality of convex portions.

11. The towel heating barrel according to claim 7, wherein each of the plurality of ventilation holes is in a shape which is wide in the middle and narrow on both sides, and a length direction of each of the plurality of ventilation holes is consistent with the air blowing direction of the air outlet mechanism.

12. The towel heating barrel according to claim 7, wherein the air chamber comprises a first chamber and a second chamber, the air outlet mechanism is located between the first chamber and the second chamber, and the air outlet mechanism defines two air outlets opposite to each other; one of the two air outlets is communicated with the first chamber, and the other of the two air outlets is communicated with the second chamber, and the air outlet mechanism is configured to blow air to the first chamber through one of the two air outlets and blow air to the second chamber through the other of the two air outlets.

13. The towel heating barrel according to claim 12, wherein the air outlet mechanism comprises a housing, a blower, and an air guide member, the housing is mounted in the base, the housing defines a working chamber, an air inlet, and the two air outlets, and each of the air inlet, and the two air outlets is communicated with the working chamber;

each of the blower and the air guide member is arranged in the working chamber, and the blower is configured to draw air from the air inlet and blow the air towards the air guide member;

the air guide member comprises two air guide portions connected with each other, and each of the two air guide portions extends inclinedly towards a respective one of the two air outlets.

14. The towel heating barrel according to claim 13, wherein each of the two air guide portions is arranged in an arc shape, and air blowing directions at the two air outlets are parallel to each other or lie on a same straight line.

15. The towel heating barrel according to claim 12, wherein the air chamber further comprises a third chamber, and the first chamber and the second chamber are communicated with each other via the third chamber;

the air outlet plate comprises a first corrugated portion, a second corrugated portion, and a connecting plate, the first corrugated portion is arranged above the first chamber, the second corrugated portion is arranged above the second chamber, and each of the first corrugated portion and the second corrugated portion defines the plurality of ventilation holes; the connecting plate is connected between the first corrugated portion and the second corrugated portion, and the connecting plate is arranged above the air outlet mechanism and the third chamber.

16. The towel heating barrel according to claim 15, wherein each of the first corrugated portion and the second corrugated portion uniformly defines the plurality of the ventilation holes, and the connecting plate defines the plurality of ventilation holes above an area of the third chamber without covered by the air outlet mechanism.

17. The towel heating barrel according to claim 7, wherein the air chamber comprises a first chamber and a second chamber, and the air outlet mechanism is arranged between the first chamber and the second chamber;

the air outlet mechanism defines two air outlets opposite to each other, one of the two air outlets is communicated with the first chamber, and the other of the two air outlets is communicated with the second chamber, and the air outlet mechanism is configured to blow air to the first chamber and the second chamber through the two air outlets;

the towel heating barrel further comprises at least two hanging rods, the at least two hanging rods are mounted in the placement chamber, and each of two of the at least two hanging rods is arranged above a respective one of the first chamber and the second chamber.

18. A towel heating barrel, comprising:

a frame body, defining an opening;

a base;

an enclosing member, flexible and arranged between the frame body and the base, wherein the enclosing member, the frame body, and the base cooperatively define a placement chamber, and the opening is communicated with the placement chamber; and a support member, movably arranged between the frame body and the base, configured to enable the frame body and the base to move close to or away from each other and enable the enclosing member to be folded or unfolded;

an air outlet mechanism, comprising: a housing, a blower arranged inside the housing; and at least one heating element, arranged inside the housing; wherein, the housing defines a plurality of air outlets;

wherein, a side of the base facing away from the placement chamber defines a recess; the housing of the air outlet mechanism is accommodated in the recess, the base further defines a plurality of communication ports, the placement chamber and the recess are communicated with each other via the plurality of communication ports, and plurality of communication ports are formed on recess walls of the recess; the plurality of air outlets are communicated with the plurality of communication ports.

19. The towel heating barrel according to claim 18, wherein the air outlet mechanism further comprises a control panel, and the control panel is exposed from an outer side of the base.

* * * * *